United States Patent [19]

LaFlaquiere et al.

[11] 4,159,620

[45] Jul. 3, 1979

[54] YARN-PIECING AND CLEANING SYSTEM FOR A SPINNING MACHINE

[75] Inventors: Régis LaFlaquiere; Radé Janousek, both of Mulhouse, France

[73] Assignee: Societe Alsacienne de Constructions Mecaniques de Mulhouse, France

[21] Appl. No.: 873,944

[22] Filed: Jan. 31, 1978

[30] Foreign Application Priority Data

Feb. 2, 1977 [FR] France ..... 77 02838

[51] Int. Cl.[2] ..... D01H 11/00; D01H 15/00

[52] U.S. Cl. ..... 57/301; 57/263

[58] Field of Search ..... 57/1 R, 22, 23, 34 R, 57/34.5, 53, 56, 58.89–58.95

[56] References Cited

U.S. PATENT DOCUMENTS

| | | | |
|---|---|---|---|
| 3,374,118 | 3/1968 | Seress | 57/56 X |
| 3,913,190 | 10/1975 | Savageau et al. | 57/34 R X |
| 3,950,926 | 4/1976 | Stahlecker | 57/34 R |
| 4,038,812 | 8/1977 | Stahlecker | 57/56 |
| 4,060,963 | 12/1977 | Stahlecker | 57/34 R |
| 4,089,155 | 5/1978 | Stahlecker | 57/58.89 X |

*Primary Examiner*—Donald Watkins
*Attorney, Agent, or Firm*—Holman & Stern

[57] ABSTRACT

The yarn-piecing and cleaning system comprises an auxiliary carriage which is separate and distinct from the robot carriage but travels on the same track as this latter, is connected thereto by means of at least one compressed-air duct and contains a compressed-air generating set. Thus the design function of the auxiliary carriage is to supply air directly at the necessary pressure and also serves as a spinning waste reservoir while the robot carriage performs yarn-piecing and cleaning operations as a transfer and control unit.

6 Claims, 2 Drawing Figures

1
2
4
5
8
9
10
11
12

1
2
3
4
5
6
7
8
9
II
II

YARN-PIECING AND CLEANING SYSTEM FOR A SPINNING MACHINE

This invention relates to a yarn-piecing and cleaning system for a spinning machine, especially for an open-ended spinning machine of the type comprising a so-called "robot" carriage which travels in front of the spinning units.

In these machines, the main function of the robot is to piece yarns which have broken accidentally during formation and to carry out periodic cleaning of the yarn formation units of said machines.

The yarn-piecing function is performed by bringing the formed length of yarn back into the corresponding yarn formation unit and by producing a partial vacuum within this latter in order to suck the end of said length of yarn while the unit is operating. Piecing is effected between separated lengths or between the end of the formed yarn and that of the yarn which is being formed, whereupon the pieced yarn is removed from the machine and wound onto the receiving bobbin.

The function of cleaning of yarn formation units is carried into effect by removing yarn waste from said units. These cleaning operations take place periodically in such a manner as to manufacture a yarn of constant quality and are carried out by suction of the waste just mentioned.

Thus, in addition to the elements which are necessary for other functions such as opening of the protective casings of the yarn formation units, the piecing or cleaning robot must further comprise means for producing a partial vacuum or suction within the yarn formation units. With this objective, one expedient adopted in the prior art consisted in placing a general conduit or air duct of substantial length above the spinning machine, the duct being connected to a stationary suction and filtration set and the robot being connected to the duct in order to perform the two functions mentioned above. Apart from the fact that said duct must have a sufficient length to enable the robot to operate in all active positions and that provision has to be made for different devices of more of less complicated design in order to connect the robot to the duct, pressure drops inevitably occur within said duct and are liable to affect the good operation of the robot. Pressure variations consequently take place at the level of the yarn formation units and the pressures may prove insufficient to piece the yarn and/or to clean said units.

Furthermore, the removable connections between the robot and the general duct may exhibit defective leak-tightness at the time of coupling and this may in turn be the cause of faulty operation. Said removable connections are liable to become clogged with different waste products, bits of yarn, and so on.

The aim of the present invention is to overcome the disadvantages mentioned in the foregoing and to propose a piecing and cleaning system for a spinning machine, which is of very simple design while at the same time offering both safety and reliability of operation.

The invention is directed to a system of the type comprising at least one main carriage, a yarn-piecing and cleaning system for a spinning machine and especially for an open-ended machine, of the type comprising at least one robot carriage which travels on one track along the machine and carries out piecing and cleaning operations at least to a partial extent by compressed air. The system aforesaid essentially comprises an auxiliary carriage which is separate and distinct from the robot carriage and contains a compressed-air generating set, said auxiliary carriage being connected to the robot by means of at least one compressed-air duct. In consequence, by incorporating a compressed-air generating set in the auxiliary carriage, the fluid can accordingly be supplied directly from said auxiliary carriage at the necessary pressure, the robot carriage being employed for the above-mentioned functions as a transfer and control unit.

In accordance with another distinctive feature of the invention, the auxiliary carriage travels on the same track as the robot carriage either upstream or downstream of this latter, thus permitting the use of existing installations.

In accordance with yet another distinctive feature, the auxiliary carriage constitutes an independent reservoir for the cleaning waste.

In accordance with a further distinctive feature, the auxiliary carriage is connected to the robot carriage by means of a flexible duct in such a manner as to move them towards or away from each other according to requirements and also according to the profile of the track on which they travel. Said track can have curved sections when it is mounted around one or a number of spinning machines.

Further advantages and features will be brought out by the detailed description given below and by the accompanying drawings in which one embodiment of the invention is illustrated by way of example without any limitation being implied, and in which.

A spinning machine of the open-ended type comprises a frame 1 on which are mounted spinning stations 2 or yarn formation units, and a main robot carriage 3 which travels on rails 4, said rails being rigidly fixed to the frame 1. The design function of said robot carriage 3 is to place together the lengths of yarn which have been cut accidentally during formation and to carry out periodic cleaning of the spinning stations by sucking the waste which has accumulated in said stations in order to obtain perfectly clean surfaces and therefore to ensure better yarn formation.

Figure 2:
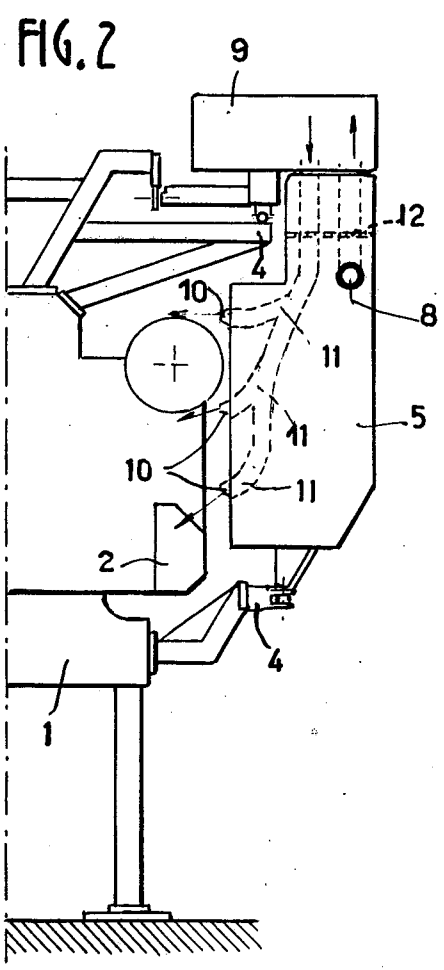
FIG. 2 is a part-sectional view taken along line II—II of FIG. 1.
Figure 1:
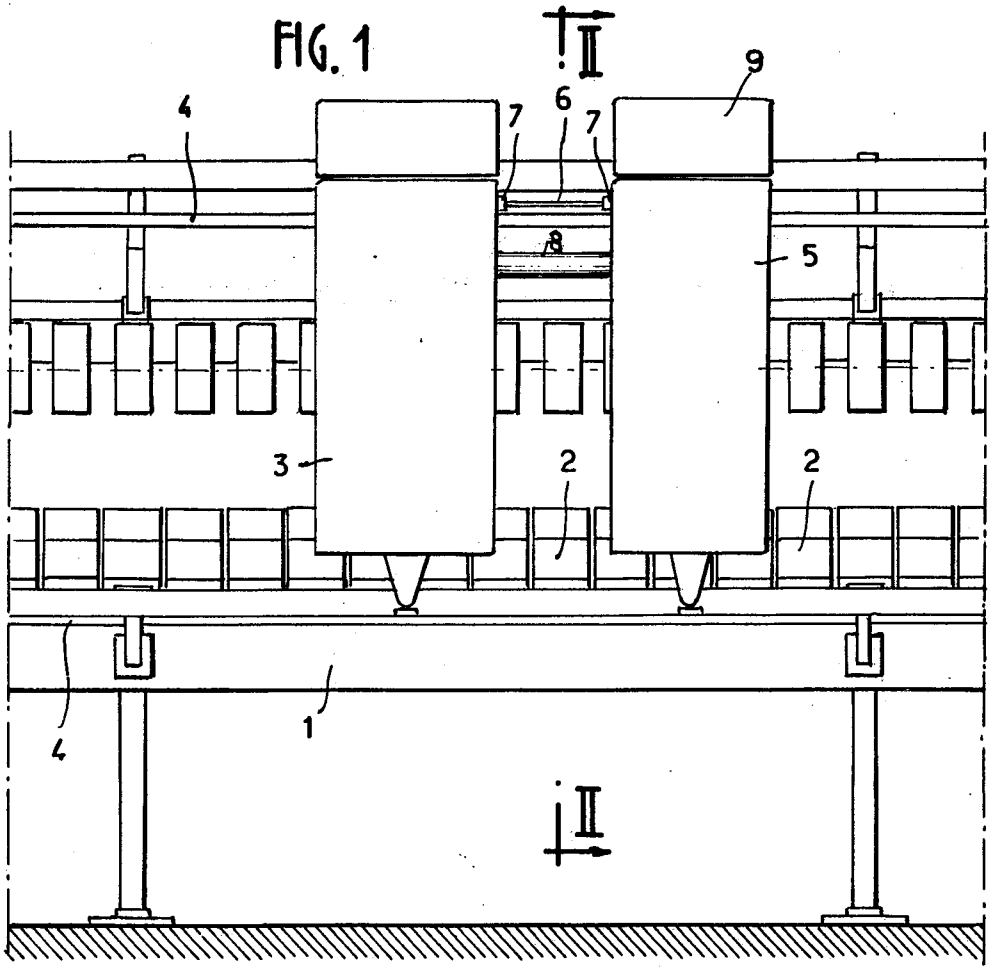
FIG. 1 is a partial side view of a spinning machine of the open-ended type equipped with a yarn-piecing robot carriage and with an auxiliary carriage for cleaning the spinning stations.

In accordance with the invention, an auxiliary carriage 5 also travels along the rails 4 or other rolling tracks if necessary and is coupled on the one hand mechanically to the main robot carriage 3 by means of a coupling device and on the other hand fluidically to said robot carriage. These two connections can be established within a single unit or else can be separate from each other as shown in FIG. 1. In this example of construction, the coupling device is consituted by a coupling rod 6 mounted in two self-aligning bearings 7 or like devices, one of said bearings being fixed on the main robot carriage 3 whilst the other bearing is fixed on the auxiliary carriage 5. This coupling device permits easy travel in the curved portions of the rails 4 and especially at the ends of the spinning machine. Thus the main robot carriage 3 and the auxiliary carriage 5 can travel in front of and above spinning stations which are not shown in the drawing but are located behind the spinning stations 2. It is readily apparent that the length of the coupling rod 6 is a function of the radius of curvature of the curved portions of the rails 4. The fluidic connection between the main robot carriage and the auxiliary carriage is established by means of a flexible duct 8 which may be reinforced if necessary in order to endow this latter with greater strength. The flexible duct 8 provides a fluidic connection between the interior of the robot carriage 3 and the interior of the auxiliary carriage 5 which is so designed as to constitute a reservoir for spinning waste removed from the spinning stations and conveyed by the main robot carriage 3. To this end, the auxiliary carriage 5 is equipped with an independent compressed-air generator 9 which is mounted on top of said auxiliary carriage 5.

The compressed-air generator 9 can be designed to suck the yarn waste which has accumulated within the spinning stations 2 or to blow air directly into said spinning stations 2 or into other parts of the machine which it is desired to clean. Nozzles 10 are accordingly provided on the rear face of the auxiliary carriage 5 and are connected to the compressed-air generator 9 by means of ducts 11. The nozzles 10 can be either stationary or orientable in order to deliver the air jets in the desired directions. Furthermore, provision is made within the interior of the auxiliary carriage 5 for a cleanable filter 12 which serves to stop yarn waste and for a reservoir which serves to collect said waste.

As can readily be understood, the invention is not limited in any sense to the embodiment described in the foregoing with reference to the accompanying drawings. Depending on the applications which may be contemplated, many alternative embodiments within the capacity of those versed in the art can accordingly be contemplated without thereby departing either from the scope or the spirit of the invention.

From this it follows that the auxiliary carriage could be self-propelled instead of being driven by the main carriage, in which case the only remaining connection between the carriages would be the compressed-air duct 8.

We claim:

1. A yarn-piecing and cleaning system for an open-ended spinning machine, comprising:

a first carriage means travelling on a track along the machine, for carrying out piecing operations;

second carriage means, distinct from said first carriage means, for carrying out cleaning operations, said second carriage means including means mechanically coupling both of said carriage means to each other;

an air generator means for at least blowing air into said machine, said air generator means being mounted upon said second carriage;

first flexible duct means, connected to said air generator and connecting an interior of said first carriage means to an interior of said second carriage means, said second carriage means including a reservoir to collect dirt and yarn waste from said machine;

a second duct means with at least one nozzle connected to said air generator for directing said blowing air into said machine; and filter means for retaining waste in said second carriage.

2. The system in accordance with claim 1, wherein said air generator means includes means for providing a vacuum and said first flexible duct is connected to said means providing a vacuum for sucking waste from said machine and conveying said waste into said reservoir.

3. The system in accordance with claim 1, wherein said second duct means is located on said second carriage means, said second duct means including a plurality of nozzles for directing compressed air into said open-ended spinning machine.

4. The system in accordance with claim 3, wherein said second duct means is located entirely in said second carriage means and said nozzles are located on a rear wall of said second carriage means.

5. A yarn-piecing and cleaning system for an open-ended spinning machine, comprising:

a first carriage means traveling on a track along the machine, for carrying out piecing operations;

second carriage means, distinct from said first carriage means, for carrying out cleaning operations, said second carriage means including means mechanically coupling both of said carriage means to each other; and air generating means mounted with said second carriage means, for at least blowing air into said machine, said air generator means including at least one compressed air duct connecting said first carriage means to said second carriage means, said duct carrying exhausted waste from said first carriage means to a reservoir in said second carriage means.

6. The system in accordance with claim 5, wherein said second carriage means includes at least a second duct, separate and distinct from said compressed air duct, for connecting at least one nozzle on a rear wall of said second carriage means with said compressed air generator means.

* * * * *